US006920299B2

(12) United States Patent
Shimura et al.

(10) Patent No.: US 6,920,299 B2
(45) Date of Patent: Jul. 19, 2005

(54) IMAGE FORMING APPARATUS AND INTERMEDIATE TRANSFER UNIT DETACHABLY MOUNTABLE THEREON

(75) Inventors: Masaru Shimura, Shizuoka (JP); Tatsuya Kobayashi, Shizuoka (JP); Takashi Shibuya, Shizuoka (JP); Seiji Saito, Shizuoka (JP); Hidekazu Matsuda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 10/284,160

(22) Filed: Oct. 31, 2002

(65) Prior Publication Data

US 2003/0081964 A1 May 1, 2003

(30) Foreign Application Priority Data

Nov. 1, 2001 (JP) ..... 2001-336476
Oct. 17, 2002 (JP) ..... 2002-302598

(51) Int. Cl.[7] ..... G03G 15/01; G03G 15/16
(52) U.S. Cl. ..... 399/121; 399/302; 399/308
(58) Field of Search ..... 399/121, 302, 399/308

(56) References Cited

U.S. PATENT DOCUMENTS

| | | | | |
|---|---|---|---|---|
| 4,693,587 A | | 9/1987 | Shigenobu et al. | 355/3 FU |
| 5,249,023 A | | 9/1993 | Miyashiro et al. | 355/273 |
| 5,274,399 A | | 12/1993 | Uchida et al. | 346/13 |
| 5,287,163 A | | 2/1994 | Miyashiro et al. | 355/326 R |
| 5,508,796 A | | 4/1996 | Sasame et al. | 355/271 |
| 5,523,829 A | | 6/1996 | Miyashiro et al. | 355/271 |
| 5,594,538 A | * | 1/1997 | Takekoshi et al. | 399/310 |
| 5,638,158 A | | 6/1997 | Sanpe et al. | 399/174 |
| 5,659,857 A | | 8/1997 | Yamazaki et al. | 399/252 |
| 5,666,597 A | | 9/1997 | Sasame et al. | 399/128 |
| 5,890,044 A | | 3/1999 | Yamashita et al. | 399/307 |
| 5,978,638 A | | 11/1999 | Tanaka et al. | 399/302 |
| 5,995,793 A | | 11/1999 | Enomoto et al. | 399/302 |
| 6,094,556 A | * | 7/2000 | Tanaka et al. | 399/302 |
| 6,097,919 A | | 8/2000 | Takeuchi et al. | 399/298 |
| 6,175,702 B1 | | 1/2001 | Takeuchi et al. | 399/101 |
| 6,510,307 B2 | * | 1/2003 | Sato et al. | 399/313 |
| 6,516,176 B1 | * | 2/2003 | Yoshida | 399/302 |
| 6,589,700 B2 | * | 7/2003 | Tsutsumi et al. | 399/159 |

FOREIGN PATENT DOCUMENTS

| | | | | |
|---|---|---|---|---|
| CN | 1119750 A | | 4/1996 | |
| EP | 0 658 816 | | 6/1995 | |
| JP | 09-32557 | * | 12/1997 | G03G/15/01 |
| JP | 10-186893 | | 7/1998 | |
| JP | 11-052750 | * | 2/1999 | G03G/15/16 |
| JP | 11-073038 | * | 3/1999 | G03G/15/16 |
| JP | 2001-312159 | * | 11/2001 | G03G/15/16 |

* cited by examiner

*Primary Examiner*—Fred Braun
(74) *Attorney, Agent, or Firm*—Fitzpatrick, Cella, Harper & Scinto

(57) ABSTRACT

The invention provides an image forming apparatus including an intermediate transfer belt composed of a resinous material, a transfer member for transferring a toner image on the intermediate transferring belt onto a transfer material, and an opposing member provided to be opposed to the transfer member across the intermediate transferring belt. The transfer member and the opposing member can be mutually pressured, and the intermediate transferring belt and the opposing member have an integrally measured microhardness smaller than 97°. Thus the invention provides an image forming apparatus capable of preventing a transfer unevenness caused at the transfer of the toner image from the intermediate transferring belt to the transfer material, and an intermediate transfer unit which is detachably attachable to the image forming apparatus.

43 Claims, 7 Drawing Sheets

FIG. 6

| | IMAGE CONDITION | | CONVEYANCE CONDITION OF INTERMEDIATE TRANSFERRING BELT |
|---|---|---|---|
| | Xx4024 | FB | |
| FIRST EMBODIMENT (a) | ○ | △ | ○ |
| FIRST EMBODIMENT (b) | ○ | ○ | ○ |
| COMPARISON EXAMPLE 1 | × | × | ○ |
| COMPARISON EXAMPLE 2 | ○ | ○ | × |

<IMAGE CONDITION>

○ : NO IMAGE DEFFECT OF DROP OF DOTS OF TONER

△ : IMAGE DEFFECT SLIGHTLY OCCURS

× : IMAGE DEFFECT SIGNIFICANTLY OCCURS

<CONVEYANCE CONDITION>

○ : GOOD CONVEYANCE

× : BAD CONVEYANCE $$SF\ 1 = \frac{(MXLNG)^2}{AREA} \times \frac{\pi}{4} \times 100$$

$$SF\ 2 = \frac{(PERI)^2}{AREA} \times \frac{1}{4\pi} \times 100$$

IMAGE FORMING APPARATUS AND INTERMEDIATE TRANSFER UNIT DETACHABLY MOUNTABLE THEREON

BACKGROUND OF THE INVENTION

1. Field of the Invention

The present invention relates to an image forming apparatus utilizing an electrophotographic recording process such as a laser printer, a copying apparatus or a facsimile apparatus, and more particularly to an intermediate transferring unit for transferring an image on an image bearing body onto an intermediate transfer belt and further transferring the image on the intermediate transferring belt onto a transfer material, and an image forming apparatus provided with such intermediate transfer unit.

2. Related Background Art

An image forming apparatus utilizing an intermediate transferring body has conventionally been proposed in various forms exploiting an advantage of adaptability to various transfer materials, particularly as a color image forming apparatus in which plural colors are superimposed.

FIG. 10 shows an example of the image forming apparatus utilizing the intermediate transferring belt. Referring to FIG. 10, along the periphery of a photosensitive drum 101 constituting an image bearing body, there are provided charging means 102, developing means of different colors 106 (black), 107 (magenta), 108 (cyan), 109 (yellow), an intermediate transferring belt 110 and photosensitive drum cleaner 118, and each of the developing means 106 to 109 of different colors is brought into contact, when required, with the photosensitive drum 101 by unrepresented means.

The photosensitive drum 101 is uniformly charged by the charging means 102 which is applied a negative pole bias by a bias power source 103, and irradiated by exposure means 104 as information writing means with a laser beam 105 modulated with an image signal so as to form an electrostatic latent image. Then toner as a developer which is charged in the same polarity as that of the aforementioned bias power source is supplied by the developing means 106 to 109 onto the photosensitive drum 101 bearing thus formed electrostatic latent image to visualize such latent image as a toner image. Subsequently, a primary transfer roller 111 as a first transfer member is given a voltage of a polarity opposite to that of the toner by a primary transfer bias power source 112, whereby the toner image is electrostatically transferred to the intermediate transferring belt 110. The above-described process is repeated for the developing means 106 to 109 of plural colors, thereby forming a color image on the intermediate transferring belt 110. Then a secondary transfer roller 113 as a second transfer member is given a voltage of a polarity opposite to that of the toner by a secondary transfer bias power source 114 to collectively transfer the color image onto a transfer material P such as paper, and a permanent color image is obtained by fixing means 121.

Also primary transfer residual toner remaining on the photosensitive drum 101 after the primary transfer step is recovered by the photosensitive drum cleaner 118. Secondary transfer residual toner remaining on the intermediate transferring belt 110 after the secondary transfer step is recovered by a cleaner 119. The cleaner 119 is reciprocatable in a direction indicated by an arrow, and is so controlled as to be separated from the intermediate transferring belt 110 while the toner images of the different colors are in the course of the primary transfer to the intermediate transferring belt, but contacted with the intermediate transferring belt 110 after the superposed toner images of four colors are formed thereon. The intermediate transferring belt 110 is supported under a tension by a drive roller 115, an opposing roller 116 and a tension roller 117, and is driven in rotation in a direction indicated by an arrow, by the drive roller 115.

In general, the intermediate transferring belt 110 has a thickness of 150 to 200 $\mu$m and a volumic resistivity of about $10^{11}$ to $10^{16}$ $\Omega\cdot$cm, and is composed for example of an electroconductive material based principally on a thermoplastic resin such as polyimide resin (PI), polycarbonate resin (PC) #21, polyvinylidene fluoride resin (PVDF), polyalkylene phthalate resin, polyalkylene terephthalate resin (PC/PAT) blend, ethylene-tetrafluoroethylene copolymer (ETFE)/PC blend, an ETFE/PAT blend or a PC/PAT blend.

However, in the image forming apparatus of the above-described conventional technology, in case transferring a color image, formed by superposing toner images of plural colors on the intermediate transferring body, onto a transfer material such as paper by the second transfer member, there may result an image defect by a transfer failure.

Such drawback will be explained more specifically with reference to a schematic view shown in FIG. 11.

FIG. 11 is a magnified view of a vicinity of the secondary transfer portion and shows the relationship between the contact state of the transfer material P with the intermediate transferring belt 110, and the transferrability, wherein an arrow X indicates the conveying direction of the transfer material P and an arrow Y indicates a pressing direction of the secondary transfer roller 113.

The transfer material P shows a concave portion (recessed portion) A and a convex portion (protruding portion) B on the surface. In the protruding portion B in a secondary transfer nip N, the transfer material P and toner T are in mutual contact, so that the toner T can be transferred onto the transfer material by the pressure of the secondary transfer roller 113 applied by unrepresented pressurizing means and by an electrostatic force generated by the secondary transfer bias applied from the secondary transfer bias power source 114 to the secondary transfer roller 113.

On the other hand, in the concave portion A of the transfer material P, if the intermediate transferring belt 110 and the opposing roller 116 have a high hardness, the pressure of the secondary transfer roller 113 exerts only a limited influence to weaken the contact between the transfer material P and the toner T, so that the transfer is executed only by the electrostatic force generated by the secondary transfer bias applied from the secondary transfer bias power source 114 to the secondary transfer roller 113 and the transferrability is deteriorated.

As the transferrability becomes different corresponding to the convex and concave portions of the transfer material P as explained in the foregoing, there result image defects such as an unevenness in the density, an unevenness in the color hue particularly in case plural colors such as a secondary color or a tertiary color are superposed, or a transfer failure causing a spot-like toner dropout in the concave portion of the transfer material P.

Such phenomena becomes particularly conspicuous in the case of a multi-color superposing where the amount of the toner T becomes larger, and, in such case, the transfer becomes difficult to realize by the electrostatic force only and evidently causes image defects such as an unevenness in color or a transfer failure causing a spot-like toner dropout.

Also the image defects based on such phenomena do not appear on a coated paper with little irregularities on the surface or a smooth paper (exclusive paper for color), but are conspicuous on a paper of an inferior surface with significant surface irregularities (plain paper or rough paper).

SUMMARY OF THE INVENTION

An object of the present invention is to provide an image forming apparatus capable of preventing a transfer unevenness generated when a toner image on the intermediate transferring belt is transferred onto a transfer material, and an intermediate transfer unit to be detachably mounted on such image forming apparatus.

Another object of the present invention is to provide an image forming apparatus comprising an image bearing body, an intermediate transferring belt formed with a resinous material, a transfer member for transferring the toner image on the intermediate transferring belt onto a transfer material, and an opposing member which is provided to be opposed to the transfer member across the intermediate transferring belt, wherein the toner image on the image bearing body is transferred onto the intermediate transferring belt, the transfer member and the opposing member can be mutually pressured, and the intermediate transferring belt and the opposing member have an integrally measured microhardness A smaller than 97°.

Further object of the present invention is to provide an intermediate transfer unit comprising an intermediate transferring belt composed of a resinous material and an opposing member provided to be opposed to a transfer member which transfers a toner image on the intermediate transferring belt onto a transfer material, wherein the intermediate transferring belt and the opposing member have an integrally measured microhardness A smaller than 97°.

Still further objects of the present invention will become fully apparent from the following description.

BRIEF DESCRIPTION OF THE DRAWINGS

FIG. 6 is a table showing the results of evaluation of the image transferrability and the conveying ability of the intermediate transferring belt in a durability test;

DESCRIPTION OF THE PREFERRED EMBODIMENTS

<First Embodiment>

Figure 1:
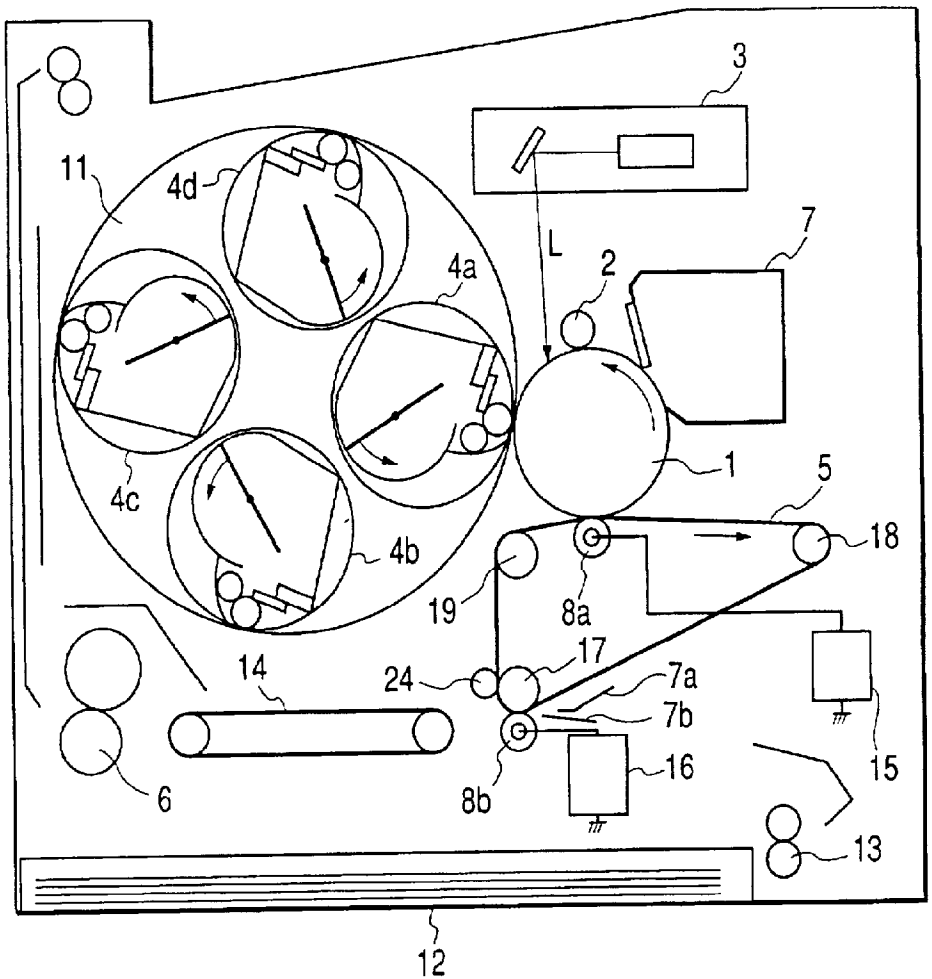
FIG. 1 is a schematic view showing the configuration of an image forming apparatus constituting a first embodiment of the present invention.
Figure 2:
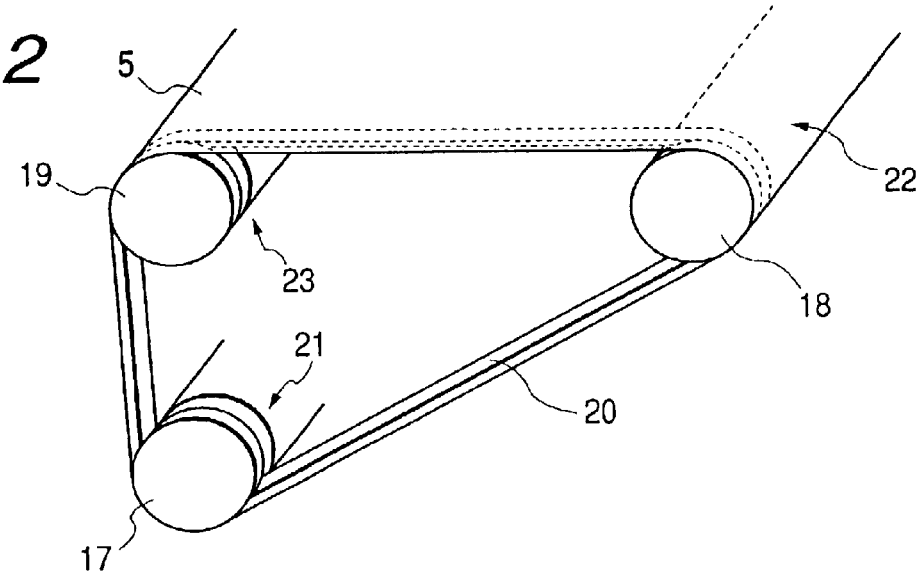
FIG. 2 is a view showing the conveying operation of an intermediate transferring belt.
Figure 3:
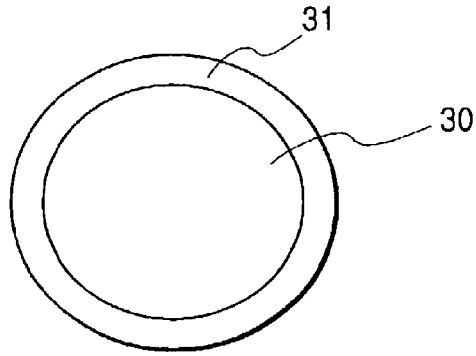
FIG. 3 is a view showing the configuration of an opposing member.
Figure 4:
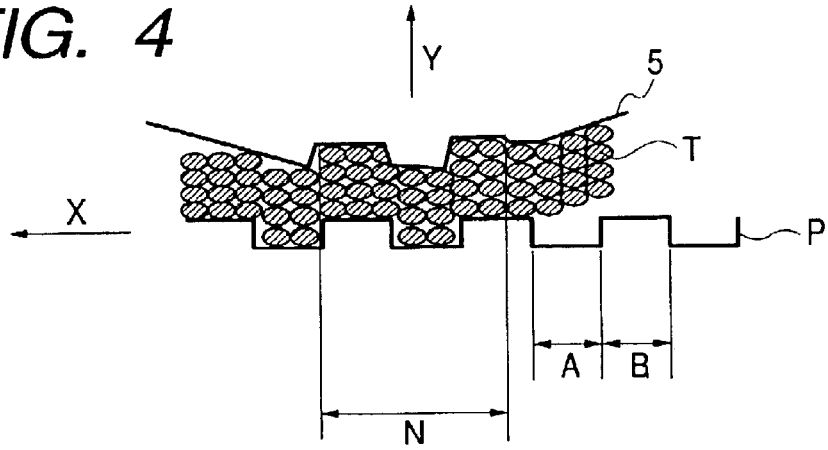
FIG. 4 is a magnified view of a vicinity of a secondary transfer portion.
Figure 5:
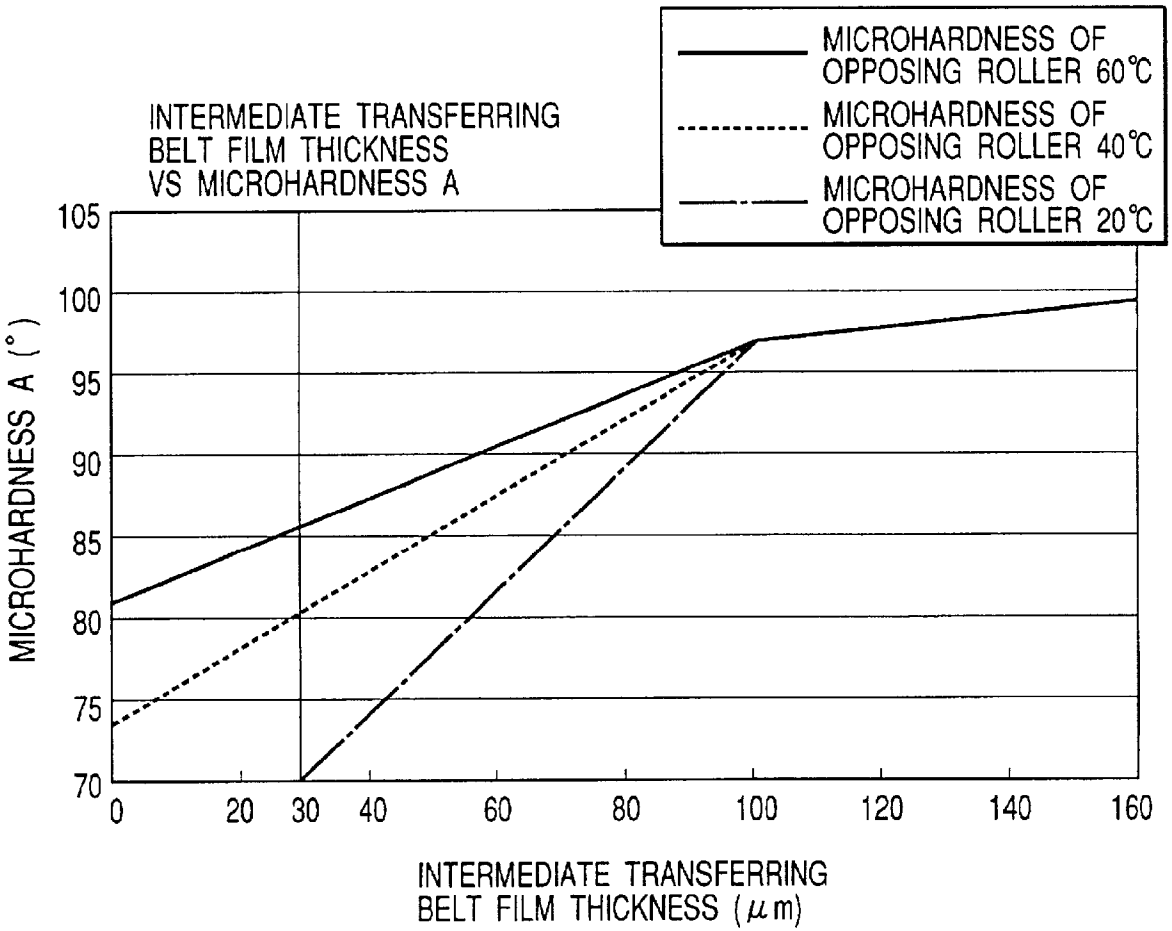
FIG. 5 is a diagram showing the relationship between the film thickness of the intermediate transferring belt and an integral hardness of the intermediate transferring belt and the opposing member.

In the following there will be explained a first embodiment of the image forming apparatus of the present invention, with reference to the accompanying drawings. FIG. 1 is a schematic view showing the configuration of an image forming apparatus of a first embodiment; FIG. 2 is a view showing the conveying operation of an intermediate transferring belt; FIG. 3 is a view showing the configuration of an opposing member; FIG. 4 is a magnified view of a vicinity of a secondary transfer portion; FIG. 5 is a diagram showing the relationship between the film thickness of the intermediate transferring belt and an integral hardness of the intermediate transferring belt and the opposing member; and FIG. 6 is a table showing the results of evaluation of the image transferrability and the conveying ability of the intermediate transferring belt in a durability test.

As shown in FIG. 1, a photosensitive drum 1 constituting the image bearing body and composed of a negatively chargeable organic photo-conductive (OPC) photosensitive body of a diameter of 47 mmϕ is driven by an unrepresented drive means in a direction indicated by an arrow in the drawing and is uniformly charged to −650 V by a charging roller 2 as the charging means. Then an exposure apparatus 3 as the information writing means irradiates the photosensitive drum 1 with a laser light L according to a yellow image pattern to form an electrostatic latent image on the photosensitive drum 1.

When the photosensitive drum 1 proceeds in the direction of the arrow, among developing apparatus 4*a*, 4*b*, 4*c*, 4*d* supported by a rotary support member 11, developing means 4*a* containing yellow toner is so moved as to be opposed to the photosensitive drum 1, whereby the latent image is rendered visible by the selected developing means 4*a*.

An intermediate transferring belt 5, constituting the intermediate transferring body and having an endless shape, is supported by an opposing roller 17 which is an opposing member constituting an opposed portion for a secondary transfer roller 8*b* serving as the second transfer member, a drive roller 18 serving as a drive member for the intermediate transferring belt 5, and a tension roller 19 constituting a tension member for the intermediate transferring belt 5, and is rotated at a speed of 101% with respect to that of the photosensitive drum 1.

The secondary transfer roller 8*b* and the intermediate transferring belt 5 can be mutually pressured through the intermediate transferring belt 5, and the opposing roller 17 constitutes a back-up member for the secondary transfer roller 8*b*.

Also, as shown in FIG. 2, the intermediate transferring belt 5 includes a rib 20 formed by a rubber member on its rear surface, while the opposing roller 17, the drive roller 18 and the tension roller 19 are provided, at an end portion thereof, with guide members 21, 22, 23 for guiding the rib 20, thereby preventing the lateral displacement of the intermediate transferring belt 5 and stabilizing the conveying thereof.

The toner image formed and borne on the photosensitive drum 1 is primary transferred onto the external periphery of the intermediate transferring belt 5, by a primary transfer bias voltage applied to a primary transfer roller 8*a* constituting the first transfer member by a primary transfer bias power source 15.

The above-described process is repeated for yellow color, magenta color, cyan color and black color to obtain toner images of plural colors on the intermediate transferring belt 5.

Then, at a predetermined timing, a transfer material constituting the recording material is fed from a transfer material cassette 12 by a pick up roller 13. At the same time, the secondary transfer roller 8*b* and the opposing roller 17 are mutually pressured through the intermediate transferring belt 5, and a secondary transfer bias voltage is applied to the secondary transfer roller 8*b* by a secondary transfer bias power source 16 whereby the toner image is transferred from the intermediate transferring belt 5 to the transfer material.

The transfer material is further conveyed by a conveying belt 14 to the fixing apparatus 6 and subjected to a fixation by fusion whereby a color image is obtained. Also the transfer residual toner on the intermediate transferring belt 5 is given a charge by an intermediate transfer cleaning roller 24 and is inversely transferred onto the photosensitive drum at a next primary transfer. The use of the intermediate transfer cleaning roller as the cleaning means for the intermediate transferring belt 5 allows to reduce the stress applied to the intermediate transferring belt 5 in comparison with the blade cleaning means in the conventional art, thereby preventing a breakage or a scar of the intermediate transferring belt 5. On the other hand, the transfer residual toner on the photosensitive drum 1 is removed by known blade cleaning means 7.

The image forming apparatus of the present embodiment employs the developing means 4*a* to 4*d* supported by the rotary support member 11, but such configuration is not restrictive and the present invention can naturally be applied with similar effects to an image forming apparatus of so-called tandem type in which the photosensitive drum 1 is employed in a number same as that of the developing means.

In the following there will be given a more detailed explanation on the opposing roller 17 and the intermediate transferring belt 5 employed in the present embodiment. As shown in FIG. 3, the opposing roller 17 is constituted by an aluminum metal core 30 of a diameter of 28 mmϕ and a rubber layer 31 serving as an elastic layer and composed of EPDM of a thickness of 1 mm. It has a resistance of $5\times10^3$ Ω (under the application of DC 50 V) and a microhardness of 20° to 60°.

The microhardness is measured with MICRODUROMETER (MD-1), manufactured by Kobunshi Keiki Co., in a state where the rubber layer is formed on the metal core 30.

The rubber layer on the surface of the opposing roller 17 may be composed of NBR, epichlorohydrin, butadiene rubber, butyl rubber or a mixture thereof.

The two-following intermediate transferring belt 5 is employed in the measurement, namely: (a) a single-layered polyvinylidene fluoride (PVDF) in which an electroconductive agent is dispersed and which has a peripheral length of 450 mm, a resistance of $10^{11}$ Ω·cm, a film thickness of 100 μm and a microhardness A of 97° measured integrally on the opposing roller 17 and the intermediate transferring belt 5; and (b) a single-layered polyvinylidene fluoride (PVDF) in which an electroconductive agent is dispersed and which has a peripheral length of 450 mm, a resistance of $10^{11}$ Ω·cm, a film thickness of 80 μm and a microhardness A of 92° measured integrally on the opposing roller 17 and the intermediate transferring belt 5.

The microhardness mentioned above is measured with MICRODUROMETER (MD-1), manufactured by Kobunshi Keiki Co., and the measurement is executed from the front surface side of the belt in a state where the intermediate transferring belt 5 is wound almost without a gap on the opposing roller 17. A similar measurement data can be obtained also by measuring a contacting portion of the intermediate transferring belt 5 with the opposing roller 17 in a state where the intermediate transferring belt 5 is supported under a tension in an integral unit including the intermediate transferring belt 5 and the opposing roller 17.

The film thickness of the intermediate transferring belt 5 is measured with a micrometer. For example, the intermediate transferring belt 5 has a thickness of 30 to 100 μm, preferably 60 to 90 μm, and a volumic resistivity of 108 to $10^{16}$ Ω·cm, preferably $10^9$ to $10^{13}$ Ω·cm.

The present embodiment employs an intermediate transferring belt 5 composed of PVDF, but there can also be employed other materials for example resinous materials such as polystyrene, polyamide, polyethylene terephthalate (PET), polycarbonate or a mixture thereof.

In the following there will be explained the features and functions of the present embodiment.

In the present embodiment, the microhardeness A of the intermediate transferring belt 5 and the opposing roller 17 is within a range 70°<A<97°, preferably 80°<A<95°, and the film thickness of the intermediate transferring belt 5 is within a range of 30 to 100 μm.

Now reference is made to a schematic view shown in FIG. 4, for explaining the relationship between the contact of the transfer material P with the intermediate transferring belt 5, and the transferrability. FIG. 4 is a magnified view of a vicnity of the secondary transferring portion, wherein an arrow X indicates the conveying direction of the transfer material P and an arrow Y indicates a pressing direction of the secondary transfer roller 8*b*.

The transfer material P shows a concave portion A and a convex portion B on the surface. In the protruding portion B in a secondary transfer nip N, the transfer material P and toner T are in mutual contact, so that the toner T can be transferred onto the transfer material P by the pressure of the secondary transfer roller 8*b* applied by unrepresented pressurizing means and by an electrostatic force generated by the secondary transfer bias applied from the secondary transfer bias power source 16 to the secondary transfer roller 113.

In the case A<97°, the toner T in the convex portion B of the transfer material P is embedded to the intermediate transferring belt 5 by the pressure of the secondary transfer roller 8*b*, and the toner T and the transfer material P are in close contact even in the recessed portion A. Therefore the toner T can be uniformly transferred to the transfer material P regardless of the surface irregularities of the transfer material P. Consequently a satisfactory image can be obtained without image defects such as a density unevenness resulting from a transfer failure, an unevenness in color or a transfer failure causing a spot-like toner dropout.

Then, FIG. 5 shows the result of measurement of a relationship between the film thickness of the intermediate transferring belt 5 and the microhardness A measured integrally on the opposing roller 17 and the intermediate transferring belt 5. According to the result in FIG. 5, in case the film thickness of the intermediate transferring belt 5 exceeds 100 μm, the microhardness A is not changed by a change in the hard ness of the opposing roller 17 and becomes A>97°, thereby causing the aforementioned transfer failure.

On the other hand, in the case the film thickness of the intermediate transferring belt 5 is less than 30 μm (in such case there may result a situation A≦70°), the strength of the intermediate transferring belt 5 becomes deficient. Consequently there is generated a misregistration in which the toner images of plural colors are mutually displaced at the transfer position. Also the tension applied to the intermediate transferring belt 5 causes a permanent elongation thereof. Furthermore, at the image formation, the intermediate transferring belt 5 is conveyed in a rotary motion with a predetermined difference in the peripheral speed with respect to that of the photosensitive drum 1, but the deficient strength of the intermediate transferring belt 5 results in a conveying failure in which the rib 20 provided on the rear surface of the intermediate transferring belt 5 rides on the guide members 21, 22, 23 provided for preventing the lateral displacement thereof.

Consequently, the film thickness of the intermediate transferring belt 5 is selected equal to 30 $\mu$m or larger (in this state there is attained a relation A>70°) to obtain a sufficient rigidity thereof, thereby preventing misregistration and realizing an image of a high definition. Also the intermediate transferring belt 5 can be prevented from the permanent elongation and there can be used a sufficient tension. In addition, there can be prevented the conveying failure in which the rib 20, provided on the rear surface of the intermediate transferring belt 5, rides on the guide members 21, 22, 23 provided for preventing the lateral displacement thereof.

Also a microhardness A>80° allows to select a larger film thickness for the intermediate transferring belt and further increases the rigidity of the intermediate transferring belt 5, thereby expanding the margin for the misregistration and the permanent elongation and advantageously extending the service life of the intermediate transferring belt.

On the other hand, in the case the microhardness A, measured integrally on the intermediate transferring belt and the opposing roller, satisfies a relation A<95°, the toner and the transfer material can be contacted more closely thereby achieving satisfactory image formation without a transfer failure, even on a rougher paper.

Based on the foregoing, the microhardness A, measured integrally on the intermediate transferring belt and the opposing roller satisfying a condition A<97°, allows to obtain a satisfactory image without image defects such as a density unevenness resulting from defective transfer, an unevenness in color or a transfer failure causing a spot-like toner dropout.

Also the film thickness of the intermediate transferring belt selected within a range of 30 to 100 $\mu$m allows to realize stable conveying of the intermediate transferring belt, without affecting the prevention of the transfer failure.

Also in the case of the film thickness within this range, the microhardness A measured integrally on the intermediate transferring belt and the opposing roller can be maintained within a range 70°<A<97°.

In consideration of the prevention of the transfer failure and the strength of the intermediate transferring belt, the microhardness A is more preferably within a range of 80°<A<95°.

As explained in the foregoing, the present embodiment is capable not only of realizing stable conveying of the intermediate transferring belt but also of image defects resulting from a defective transfer such as a density unevenness, a color unevenness or a transfer failure causing a spot-like toner dropout.

(Evaluation of Embodiment)

In order to examine the effect of the image forming apparatus of the present embodiment, an image forming apparatus of a process speed of 120 mm/sec was passed, together with a comparative example to be explained in the following, with a letter-sized recording paper, Premium Multipurpose 4024 paper supplied by Xerox Corp. (hereinafter represented as Xx4024), of a base weight of 75 g/m$^2$ as a representative example of plain paper and a letter-sized recording paper, Fox River Bond supplied by Fox River Corp. (hereinafter represented as FB), of a base weight of 75 g/m$^2$ as a representative example of rough paper, and evaluation was made on the image defect resulting from a defective transfer causing a spot-like dropout of the toner of a secondary color in the image and the conveying performance of the intermediate transferring belt 5.

COMPARATIVE EXAMPLE 1

The intermediate transferring belt is composed of single-layered polyvinylidene fluoride (PVDF) in which an electroconductive agent is dispersed, and has a resistance of 1011 Ω·cm and a film thickness of 130 $\mu$m. The opposing roller is composed of an aluminum metal core of a diameter of 28 mmϕ, and an EPDM layer of a thickness of 1 mm. It has a resistance of $5\times10^3$ Ω and a microhardness A of 98° measured integrally on the opposing roller and the intermediate transferring belt.

COMPARATIVE EXAMPLE 2

The intermediate transferring belt is composed of single-layered polyvinylidene fluoride (PVDF) in which an electroconductive agent is dispersed, and has a resistance of $10^{11}$ Ω·cm and a film thickness of 25 $\mu$m. The opposing roller is composed of an aluminum metal core of a diameter of 28 mmϕ, and an EPDM layer of a thickness of 1 mm. It has a resistance of $5\times10^3$ Ω and a microhardness A of 60° measured with including the opposing roller and the intermediate transferring belt integrally.

(Result of Evaluation)

FIG. 6 shows the result of evaluation on the image in a durability test and on the intermediate transferring belt, in the image forming apparatus of the present embodiment and of the comparative examples.

The image forming apparatus of the present embodiment employing the aforementioned intermediate transferring belt 5 (a) did not show the image defect such as the defective transfer causing a spot-like dropout on the plain paper Xx4024, but showed a slight image defect of a practically acceptable level on the FB paper of inferior surface quality.

On the other hand, the image forming apparatus employing the aforementioned intermediate transferring belt 5 (b) did not show the image defect both on the plain paper Xx4024 and the paper FB of interior surface quality.

Also in either case, there was not generated the riding of the rib 20 on the guide members 21, 22, 23 resulting from the conveying failure of the intermediate transferring belt 5.

The comparative example 1 did not show the riding of the rib 20 on the guide members resulting from the conveying failure of the intermediate transferring belt 5, but showed an image defect such as a transfer failure causing a spot-like dropout.

The comparative example 2 did not show the image defect such as the transfer failure causing a spot-like dropout, but showed a riding of the rib 20 on the guide members 21, 22, 23 resulting from the conveying failure of the intermediate transferring belt 5.

As explained in the foregoing, the image forming apparatus of the present embodiment is capable of maintaining a high image quality over a prolonged period and achieving stable conveying of the intermediate transferring belt 5, without causing image defects such as a density unevenness, an unevenness in color or a transfer failure causing a spot-like toner dropout, or a riding of the rib 20 of the intermediate transferring belt 5 on the guide members 21, 22, 23.

<Second Embodiment>

Figure 7:
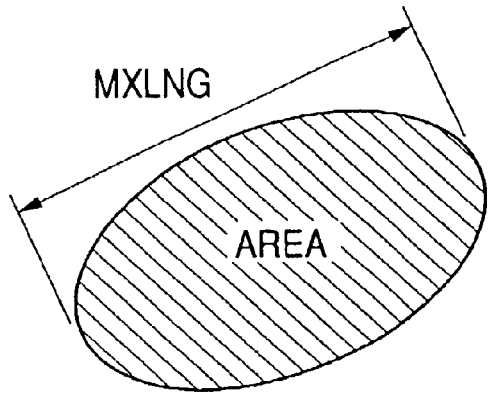
FIG. 7 is a view showing a shape factor (SF-1) of the toner in a second embodiment of the present invention.
Figure 8:
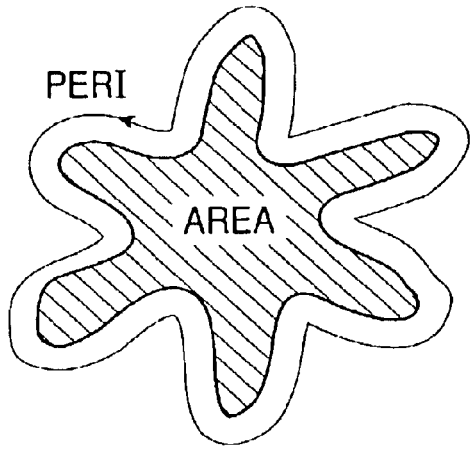
FIG. 8 is a view showing a shape factor (SF-2) of the toner in a second embodiment of the present invention.

In the following there will be explained, with reference to the accompanying drawings, a second embodiment of the image forming apparatus of the present invention. FIG. 7 is a view showing a shape factor (SF-1) of the toner of the present embodiment, and FIG. 8 is a view showing another shape factor (SF-2). In the following description, portions same as those in the foregoing first embodiment will be represented by same numbers and will not be explained further.

The present embodiment employs an intermediate transferring belt 5 and an opposing roller 17 similar to those in the first embodiment. More specifically, the intermediate transferring belt 5 and the opposing roller 17 have a microhardness A within a range of 70°<A<97°, and the intermediate transferring belt 5 has a thickness within a range of 30 to 100 μm. Also toners in the developing means 4*a* to 4*d* have a shape factor SF1 within a range of 100 to 150, and a shape factor SF2 within a range of 100 to 140.

In the following there will be given a detailed explanation on the toner to be used in the present embodiment.

In the image forming apparatus of the present embodiment, there can be employed a conventional toner that can be prepared by a grinding method or a polymerization method, but it is particularly advantageous to employ toner particles to be explained in the following.

The toner particle of the present invention preferably has a shape factor SF-1 within a range of 100 to 150 and a shape factor SF-2 within a range of 100 to 140 as measured by an image analyzing apparatus, and more preferably the shape factor SF-1 of 100 to 140 and the shape factor SF-2 of 100 to 120. Also the ratio, (SF-2)/(SF-1), selected equal to or lower than 1.0 in addition to the foregoing conditions not only realizes the characteristics of the toner particle but also achieves extremely satisfactory matching with the image forming apparatus.

As shown in FIGS. 7 and 8, the shape factors SF-1 and SF-2 to be employed in the present invention are obtained by sampling at random 100 images of the toner particles, magnified by 500 times with an FESEM (S-800) manufactured by Hitachi & Co., introducing the obtained image information into an image analyzing apparatus Luzex 3 manufactured by Nicore Co. through an interface, and executing calculation according to the following equations:

$$SF\text{-}1=\{(MXLNG)2/\mathrm{AREA}\}\times(\pi/4)\times 100 \text{ and}$$

$$SF\text{-}2=\{(PERI)2/\mathrm{AREA}\}\times(1/4\pi)\times 100$$

wherein

AREA: projected area of toner particle,

MXLNG: absolute maximum length, and

PERI: peripheral length.

The shape factor SF-1 of the toner particle indicates the level of roundness of the toner particle, and the shape of the toner particle gradually shifts from a spherical shape to an amorphous shape as this value increases. The shape factor SF-2 indicates the level of surface irregularity of the toner particle, and the surface irregularities become larger as this value increases.

In the case the aforementioned shape factor SF-1 exceeds 160, the shape of the toner particles becomes amorphous whereby the distribution of the charge amount of the toner particles becomes broader and the surface of the toner particles becomes more easily abraded in the developing device, thereby resulting in a decrease in the image density and an image fog.

Also for improving the transfer efficiency of the toner particle image, it is preferred that the shape factor SF-2 of the toner particle is within a range of 100 to 140 and the ratio of (SF-2)/(SF-1) does not exceed 1.0.

In the case the shape factor SF-2 of the toner particles exceeds 140 and the ratio (SF-2)/(SF-1) exceeds 1.0, the surface of the toner particle is not smooth but has many irregularities, so that the releasing property of the toner particles from the intermediate transferring belt 5 is deteriorated to reduce the transfer efficiency to the transfer material such as paper, thus tending to cause image defects such as a density unevenness, an unevenness in color and a transfer failure causing a spot-like toner dropout.

Therefore, the toner particle having a spherical shape improves the releasing property of the toner from the intermediate transferring belt 5, thereby further improving the transfer efficiency and preventing the image defects such as a density unevenness, an unevenness in color or a defective transfer causing a spot-like toner dropout.

As explained in the foregoing, the image forming apparatus of the present embodiment is capable of maintaining a high image quality over a prolonged period and achieving stable conveying of the intermediate transferring belt 5, without causing image defects such as a density unevenness, an unevenness in color or a transfer failure causing a spot-like toner dropout, or a riding of the rib 20 of the intermediate transferring belt 5 on the guide members 21, 22, 23.

<Third Embodiment>

Figure 9:
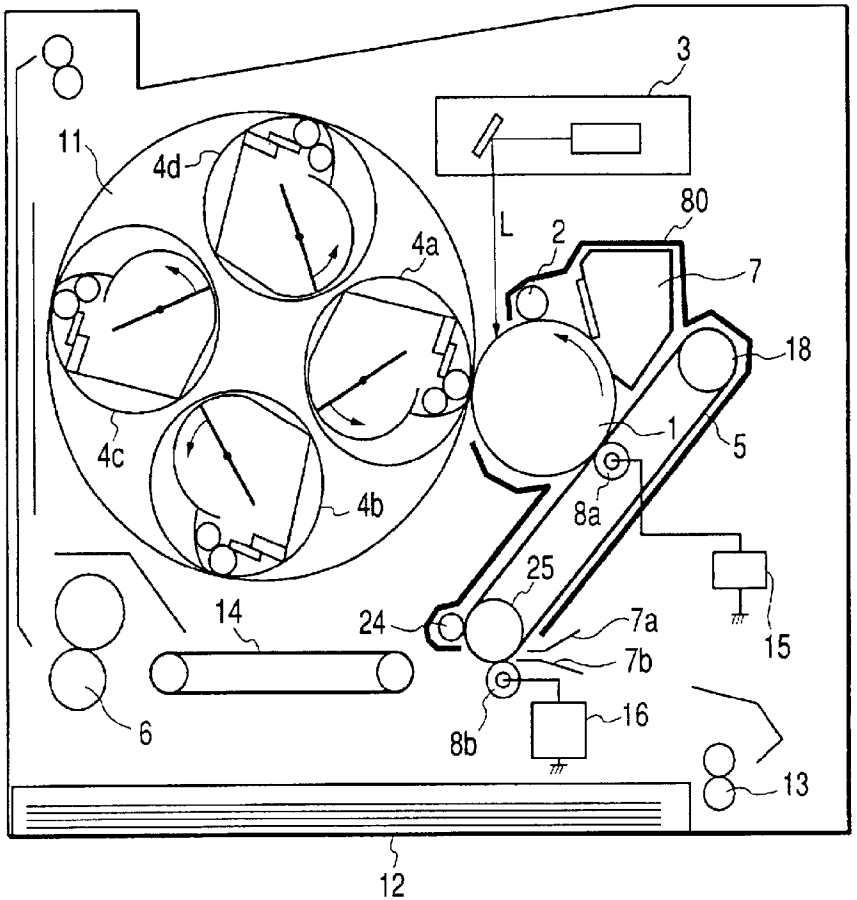
FIG. 9 is a schematic view showing the configuration of an image forming apparatus equipped with an intermediate transfer unit constituting a third embodiment of the present invention.
Figure 10:
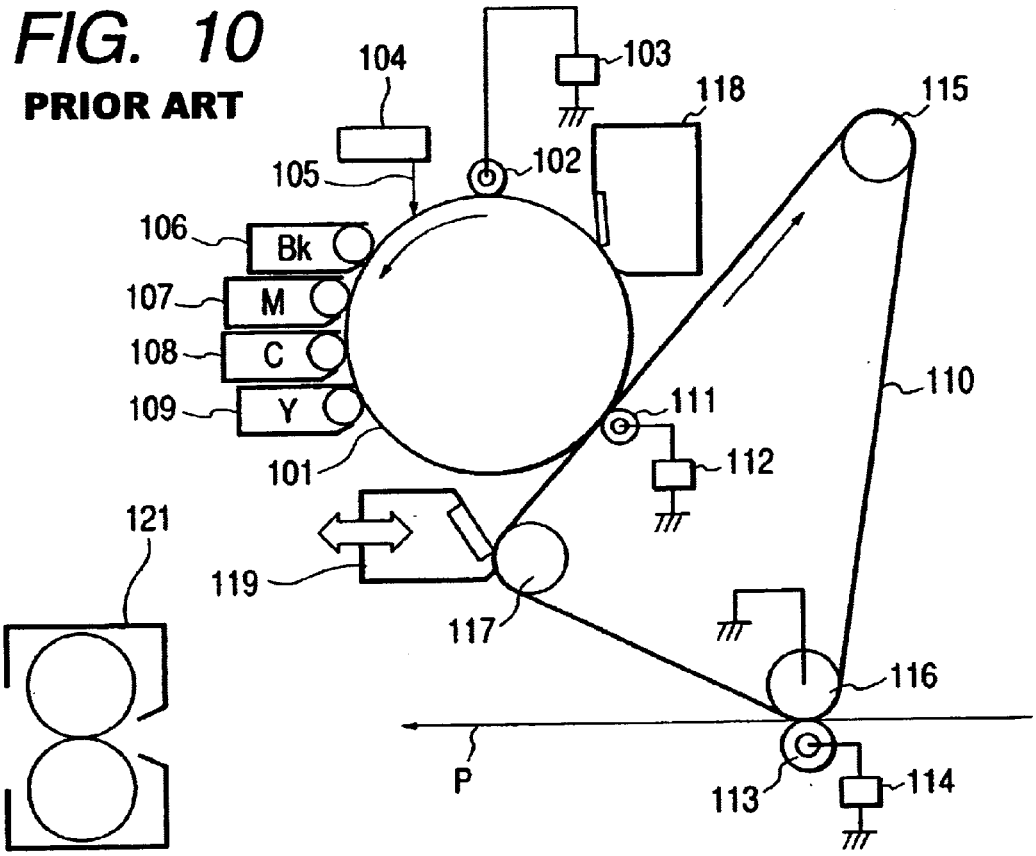
FIG. 10 PRIOR ART
FIG. 10 is a schematic view showing the configuration of a conventional image forming apparatus.
Figure 11:
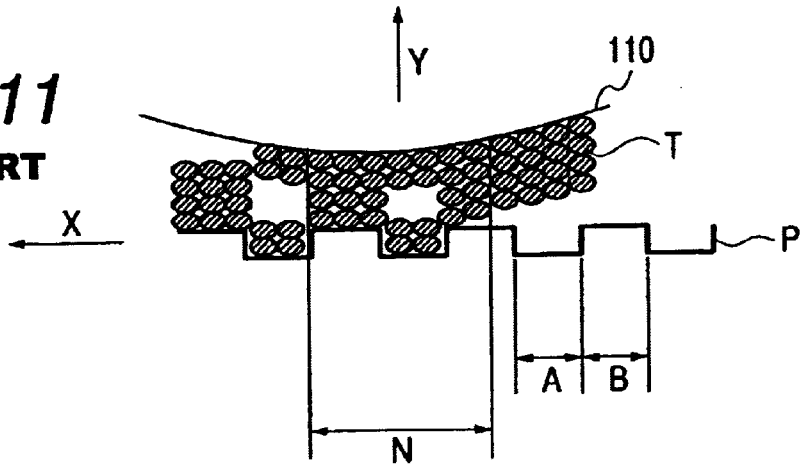
FIG. 11 PRIOR ART
FIG. 11 is a view for explaining an image defect in a conventional intermediate transferring belt and a transfer material.

In the following there will be explained, with reference to the accompanying drawings, an intermediate transfer unit and an image forming apparatus constituting a third embodiment of the present invention. FIG. 9 is a schematic view showing the configuration of an image forming apparatus of the present embodiment, wherein portions same as those in the foregoing first embodiment will be represented by same numbers and will not be explained further.

As shown in FIG. 9, in the image forming apparatus of the present embodiment, at least an intermediate transferring belt 5 and an opposing roller 25 serving also as a driving member for the intermediate transferring belt 5 are integrally formed as a unit (intermediate transfer unit), and such unit is detachably mountable to a main body of the image forming apparatus.

When the intermediate transfer unit 80 is mounted on the main body of the apparatus, the opposing roller 25 can be pressed to a transfer roller 8*b* across the intermediate transferring belt 5.

The intermediate transfer unit 80 further integrally includes a photosensitive drum 1, a charging roller 2, cleaning means 7 for the photosensitive drum 1, a tension roller 18, and an intermediate transfer cleaning roller 24 serving as cleaning means for the intermediate transferring belt 5, and the intermediate transfer unit 80 therefore also serves as an image forming unit which is detachably mountable in the main body of the image forming apparatus.

The intermediate transferring belt 5 is composed of polyvinylidene fluoride (PVDF) resin, and has a film thickness of 60 μm and a resistance of $10^{11}$ Ω·cm. The opposing roller 25 is composed of an aluminum metal core, and an EPDM layer of a thickness of 1 mm and a microhardness of 40°. The microhardness A measured integrally on the intermediate transferring belt 5 and the opposing roller 25 is 87°.

The toner T is of a shape similar to that in the second embodiment and will not therefore be explained further.

As explained in the foregoing, it is rendered possible to prevent image defects such as a density unevenness, an unevenness in color and a defective transfer causing a spot-like toner dropout, to achieve stable conveying of the intermediate transferring belt 5 thereby maintaining a high image quality over a prolonged period, and to achieve the replacement of the intermediate transferring belt 5 by a simple operation whereby the increase in the permanent elongation of the intermediate transferring belt 5 is not longer a problem.

It is also rendered possible to employ an inexpensive resin in the intermediate transferring belt 5, thereby achieving a reduction in the cost, and to alleviate the toil of the user in various maintenance works such as the replacement of the intermediate transferring belt after its service life, thereby enabling to obtain an output image in stable manner with simple operations.

As explained in the foregoing, the present invention allows to maintain a high image quality over a prolonged period and to achieve stable conveying of the intermediate transferring belt, without causing image defects such as a density unevenness, an unevenness in color or a defective transfer causing a spot-like toner dropout, or a riding of the rib of the intermediate transferring belt on the guide members.

Also by the use of an intermediate transfer unit, integrally including at least an intermediate transferring belt and an opposing member and rendered detachably mountable on an image forming apparatus, the intermediate transferring belt can be replaced by a simple operation, and the increase of the permanent elongation of the intermediate transferring belt is no longer a problem. It is also rendered possible to employ an inexpensive resin in the intermediate transferring belt 5, thereby achieving a reduction in the cost, and to alleviate the toil of the user in various maintenance works such as the replacement of the intermediate transferring belt after its service life, thereby enabling to obtain an output image in stable manner with simple operations.

In the foregoing, the present invention has been explained by embodiments thereof, but the present invention is not limited by such embodiments and includes any and all modifications within the scope of the present invention.

What is claimed is:

1. An image forming apparatus comprising:

an image bearing body;

an intermediate transferring belt composed of a single resinous layer;

wherein a toner image on the image bearing body is transferred onto the intermediate transferring belt;

a transfer member for transferring the toner image on the intermediate transferring belt onto a transfer material; and an opposing member provided to be opposed to the transfer member across the intermediate transferring belt, wherein the transfer member and said opposing member can be mutually pressured; and a microhardness measured from a surface side of the intermediate transferring belt where said opposing member contacts is less than 97°.

2. An image forming apparatus according to claim 1, wherein the intermediate transferring belt has a thickness within a range of 30 to 100 $\mu$m.

3. An image forming apparatus according to claim 1, wherein the microhardness is more than 70°.

4. An image forming apparatus according to claim 3, wherein the microhardness more than 80° and less than 95°.

5. An image forming apparatus according to claim 1, wherein the opposing member includes an elastic layer.

6. An image forming apparatus according to claim 1, wherein the opposing member is a roller.

7. An image forming apparatus according to claim 1, wherein a toner has a shape factor SF-1 within a range of 100 to 150 and a shape factor SF-2 within a range of 100 to 140.

8. An image forming apparatus according to claim 1, wherein the intermediate transferring belt has an endless shape and is wound around the opposing member.

9. An image forming apparatus according to claim 1, wherein the intermediate transferring belt and the opposing member are formed as an integral intermediate transfer unit is detachably attachable to a main body of the image forming apparatus.

10. An image forming apparatus according to claim 9, wherein the intermediate transfer unit includes the image bearing body.

11. An image forming apparatus according to claim 1, wherein a resin of the single resinous layer is PVDF, polystyrene, polyimide, PET, polycarbonate or a mixture thereof.

12. An intermediate transfer unit detachably attachable to a main body of an image forming apparatus, the transfer unit comprising:

an intermediate transferring belt composed of a single resinous layer; and an opposing member provided to be opposed, across said intermediate transferring belt, to a transfer member for transferring a toner image on said intermediate transferring belt onto a transfer material;

wherein a microhardness A measured from a surface side of the intermediate transferring belt where said opposing member contacts is less than 97°.

13. An intermediate transfer unit according to claim 12, wherein the intermediate transferring belt has a thickness within a range of 30 to 100 $\mu$m.

14. An intermediate transfer unit according to claim 13, wherein the microhardness is more than 80° and less than 95°.

15. An intermediate transfer unit according to claim 12, wherein the microhardness is more than 70°.

16. An intermediate transfer unit according to claim 12, wherein the opposing member includes an elastic layer.

17. An intermediate transfer unit according to claim 12, wherein the opposing member is a roller.

18. An intermediate transfer unit according to claim 12, wherein, when the intermediate transfer unit is attached to the main body of the image forming apparatus, the opposing member and the transfer member can be mutually pressed across the intermediate transferring belt.

19. An intermediate transfer unit according to claim 12, wherein the intermediate transferring belt has an endless shape and is wound around the opposing member.

20. An intermediate transfer unit according to claim 12, further comprising an image bearing body, wherein a toner image on the image bearing body is transferring onto the intermediate transferring belt.

21. An intermediate transfer unit according to claim 12, wherein a resin of the single resinous layer is PVDF, polystyrene, polyimide, PET, polycarbonate or a mixture thereof.

22. An intermediate transfer unit according to claim 21, wherein the opposing member includes an elastic layer.

23. An intermediate transfer unit according to claim 21, wherein the opposing member is a roller.

24. An intermediate transfer unit according to claim 21, wherein a toner has a shape factor SF-1 within a range of 100 to 150 and a shape factor SF-2 within a range of 100 to 140.

25. An intermediate transfer unit according to claim 21, wherein the intermediate transferring belt has an endless shape and is wound around the opposing member.

26. An intermediate transfer unit according to claim 21, wherein the intermediate transferring belt and the opposing member are formed as an integral intermediate transfer unit, and the intermediate transfer unit is detachably attachable to a main body of the image forming apparatus.

27. An image forming apparatus according to claim 26, wherein the intermediate transfer unit includes the image bearing body.

28. An image forming apparatus comprising:

an image bearing body;

an intermediate transferring belt having thickness within a range of 30 to 100 $\mu$m, wherein a toner image on the image bearing body is transfered onto the intermediate transferring belt;

a transfer member for transferring the toner image on the intermediate transferring belt onto a transfer material; and an opposing member provided to be opposed to the transfer member across the intermediate transferring belt, wherein the transfer member and the opposing member can be mutually pressured; and a microhardness measured from a surface side of the intermediate transferring belt where said opposing member contacts is less than 97°.

29. An image forming apparatus according to claim 28, wherein the microhardness is more than 70°.

30. An image forming apparatus according to claim 29, wherein the microhardness is more thant 80° and less than 95°.

31. An image forming apparatus according to claim 28, wherein the intermediate transferring belt includes a resinous layer.

32. An image forming apparatus according to claim 31, wherein a resin of the resinous layer is PVDF, polystyrene, polyimide, PET, polycarbonate or a mixture thereof.

33. An intermediate transfer unit detachably attachable to a main body of an image forming apparatus, the transfer unit comprising:

an intermediate transferring belt having a thickness within a range of 30 to 100 $\mu$m; and an opposing member provided to be opposed, across the intermediate transferring belt, to a transfer member for transferring a toner image on said intermediate transferring belt onto a transfer material;

wherein a microhardness measured from a surface side of the intermediate transferring belt where said opposing member contacts is less than 97°.

34. An intermediate transfer unit according to claim 33, wherein the intermediate transferring belt has a thickness within a range of 30 to 100 $\mu$m.

35. An intermediate transfer unit according to claim 33, wherein the microhardness is more than 70°.

36. An intermediate transfer unit according to claim 35, wherein the microhardness is more than 80° and less than 95°.

37. An image forming apparatus according to claim 33, wherein the intermediate transferring belt includes a resinous layer.

38. An intermediate transfer unit according to claim 37, wherein a resin of the resinous layer is PVDF, polystyrene, polyimide, PET, polycarbonate or a mixture thereof.

39. An intermediate transfer unit according to claim 33, wherein the opposing member includes an elastic layer.

40. An intermediate transfer unit according to claim 33, wherein the opposing member is a roller.

41. An intermediate transfer unit according to claim 33, wherein, when the intermediate transfer unit is attached to the main body of the image forming apparatus, the opposing member and the transfer member can be mutually pressed across the intermediate transferring belt.

42. An intermediate transfer unit according to claim 33, wherein the intermediate transferring belt has an endless shape and is wound around the opposing member.

43. An intermediate transfer unit according to claim 33, further comprising an image bearing body, wherein a toner image bearing body is transferred onto the intermediate transferring belt.

* * * * *

UNITED STATES PATENT AND TRADEMARK OFFICE

CERTIFICATE OF CORRECTION

PATENT NO. : 6,920,299 B2 
DATED : July 19, 2005
INVENTOR(S) : Masaru Shimura et al.

It is certified that error appears in the above-identified patent and that said Letters Patent is hereby corrected as shown below:

Title page,
Item [56], References Cited, U.S. PATENT DOCUMENTS, insert
-- 5,539,507 7/1996 Miyashiro et al. --.
FOREIGN PATENT DOCUMENTS, "09-32557" should read -- 09-325575 --.

Drawings,
Sheet No. 4 of 7, Figure 6, "DEFFECT" (all occurrences) should read -- DEFECT --.

Column 2,
Line 58, "becomes" should read -- become --.

Column 6,
Line 9, "of 108" should read -- of $10^8$ --.
Line 27, "vicnity" should read -- vicinity --.
Line 59, "hard ness" should read -- hardness --, and "A>97°," should read -- A$\geq$97°, --.

Column 8,
Line 16, "1011Ω·cm" should read -- $10^{11}$Ω·cm --.
Line 48, "interior" should read -- inferior --.

Column 10,
Line 5, "is" should read -- be --.
Line 6, "does" should be deleted.

Column 11,
Line 8, "not" should read -- no --.

Column 12,
Line 13, "is" should be deleted.
Line 55, "transferring" should read -- transferred --.

UNITED STATES PATENT AND TRADEMARK OFFICE

CERTIFICATE OF CORRECTION

PATENT NO. : 6,920,299 B2
DATED : July 19, 2005
INVENTOR(S) : Masaru Shimura et al.

It is certified that error appears in the above-identified patent and that said Letters Patent is hereby corrected as shown below:

Column 13,
Line 16, “transfered” should read -- transferred --.

Signed and Sealed this

Eighth Day of November, 2005

JON W. DUDAS
*Director of the United States Patent and Trademark Office*